US006779950B1

(12) United States Patent
Hutchins

(10) Patent No.: US 6,779,950 B1
(45) Date of Patent: Aug. 24, 2004

(54) REINFORCING MEMBER

(75) Inventor: Warwick Bernard Hutchins, Kew (AU)

(73) Assignee: Quantax Pty Ltd, V ictoria (AU)

( * ) Notice: Subject to any disclaimer, the term of this patent is extended or adjusted under 35 U.S.C. 154(b) by 0 days.

(21) Appl. No.: 10/383,881

(22) Filed: Mar. 10, 2003

(51) Int. Cl.[7] ..... E21D 20/00

(52) U.S. Cl. ..... 405/259.1; 405/259.5; 57/212

(58) Field of Search ..... 405/259.1, 259.5, 405/259.6, 302.2; 57/212, 213, 215, 217, 219, 223, 230, 232, 221

(56) References Cited

U.S. PATENT DOCUMENTS

| | | | | |
|---|---|---|---|---|
| 3,018,607 A | * | 1/1962 | Dietz et al. | 57/214 |
| 4,624,097 A | * | 11/1986 | Wilcox | 57/232 |
| 5,230,589 A | | 7/1993 | Gillespie | |
| 5,386,683 A | * | 2/1995 | Misrachi | 57/3 |
| 5,683,642 A | * | 11/1997 | Muguruma et al. | 264/271.1 |
| 5,738,466 A | * | 4/1998 | Ashmore et al. | 405/302.2 |
| 5,749,681 A | * | 5/1998 | Doidge et al. | 405/302.2 |

FOREIGN PATENT DOCUMENTS

| | | | | |
|---|---|---|---|---|
| AU | 94/78858 | | 5/1995 | |
| AU | 96/45582 | | 8/1996 | |
| GB | 974442 | | 11/1964 | |
| GB | 2219014 A | * | 11/1989 | D07B/1/06 |
| GB | 2281366 | | 3/1995 | |
| WO | 93/03256 | | 2/1993 | |

* cited by examiner

*Primary Examiner*—Heather Shackelford
*Assistant Examiner*—Lisa M. Saldano
(74) *Attorney, Agent, or Firm*—Dennison, Schultz, Dougherty & MacDonald

(57) ABSTRACT

A reinforcing member such as a cable bolt is formed of a multiplicity of helically stranded wires wound around a straight core or king wire. At least the outer wires are formed with a plurality of spaced helical ribs extending along the entire length thereof.

9 Claims, 2 Drawing Sheets

REINFORCING MEMBER

BACKGROUND OF THE INVENTION

The present invention relates to reinforcing members, such as cable bolts of the kind used, for example, in underground mines and construction projects to support the walls and roofs of underground excavations and openings. The invention also relates to similar reinforcing members such as pre-tensioned cables and other reinforcements for use in reinforced concrete and other structures.

In coal mines, the cable bolt is normally fixed at the inner end of a hole drilled in the mine roof by means of a two part quick curing resin such as a suitable polyester or epoxy resin. The epoxy resin is inserted into the hole in separate packaged parts and pushed to the end of the hole by insertion of the cable bolt which also causes destruction of the packaging and mixing of the parts. Rotation of the bolt during full insertion ensures proper mixing of the resin which quickly cures to secure the top of the cable bolt in the hole. In some circumstances cement grouting is then pumped into the hole to secure the bolt along its entire length, to the sides of the hole. This method of installation is not limited to coal and other mines.

The above form of cable bolt is generally tensioned (against a face plate) by hydraulic means or by torquing (rotating a nut on a thread attached to the end of the cable bolt). In some cases a cementitious slurry (referred to as cement grout) is then pumped into the hole.

Many different forms of cable bolt have been proposed in the past and the present invention is concerned with the general kind where a number of outer wires are wound around a central core in the form of a straight wire called a king wire. The outer wires are helically wound around the king wire and in some instances the king wire is replaced with a tube which allows the cement grouting to be pumped into the hole from the top down. The central tube can alternatively be used to allow air to escape from the borehole as cement grout is pumped in from the bottom. Cable bolts of the aforementioned general kind are traditionally formed of uniform diameter wire and the king wire is of a slightly larger diameter than the outer wires. The need for the slightly larger diameter king wire is because when the cable bolt is placed under tension the outer wires (usually six in number) compress against each other and cannot compress the king wire which as a consequence could be withdrawn. Therefore in order to distribute load evenly to all wires, including the king wire, it traditionally needs to be of a slightly larger diameter.

As will be appreciated the need to provide one wire of the cable bolt of different diameter causes an inconvenience for the manufacturer who needs to carry an extra stock item which must be readily identifiable and distinguishable from the other wires.

SUMMARY OF THE INVENTION

Accordingly it is an object of this invention to provide a reinforcing member such as a cable bolt which reduces the need for a significantly larger diameter king wire in a multi-wire configuration and provides other advantages over existing cable bolts and reinforcements.

The invention provides a reinforcing member formed from a multiplicity of helically stranded wires, at least some of the outermost of said wires of said multiplicity having spaced helical ribs or grooves on their surfaces.

In a preferred form of the invention, at least three of the outermost wires are formed with spaced helical ribs or grooves on their surfaces. Preferably all of the outermost wires are ribbed or grooved. The wires are preferably manufactured from high tensile steel (with a minimum tensile strength of 1570 mPa), the inner wires may be of the same or a different grade of steel, or of other materials (fibreglass, Kevlar and the like). The outer wires may alternatively be helically wound around a circular steel tube.

By forming at least some of the outermost wires with helical ribs or grooves on their surfaces, the need for a significantly larger core or king wire is avoided due to the better keying achieved by the use of ribs or grooves.

In one preferred form of the invention, the reinforcing member, which may be in the form of a cable bolt, is formed from seven wires, comprising a core or king wire, and six outer wires helically wound around said king wire, and at least three of said outer wires, and preferably all, being formed with helical ribs or grooves. The nominal diameter of the wires will generally be between about 4 mm and 9 mm or the diameter of the wire D1 will generally be between 3.8 mm and 8.8 mm. The ribs preferably have a ribbing about 5 to 30% of the nominal diameter and more preferably about 18 to 25% and most preferably 20% of the nominal wire diameter.

Preferably the king or core wire is also formed with helical ribs or grooves and may be of the same diameter as the outer wires, although in accordance with standard practice, may be 2 to 3 per cent larger or even larger if desired, than the outer wires.

The formation of helical ribs or grooves on the king or core wire reduces the likelihood of the core wire "walking" within the outer helically wound wires and therefore allows the use of a core wire of the same diameter as the outer wires.

The helical ribs or grooves are preferably formed as four start continuous ribs.

In another form the reinforcing member or cable bolt may include a central straight tube and a plurality of said wires helically wound around said tube.

BRIEF DESCRIPTION OF THE DRAWINGS

In order that the invention may be more readily understood a particular embodiment will now be described with reference to the accompanying drawings wherein.

DESCRIPTION OF THE PREFERRED EMBODIMENTS

The wires are formed from a suitable high tensile steel, preferably of 1570 mPa tensile strength, although it may be possible to form the wires, including the core or king wire from a suitable plastics material, such as Kevlar, fibreglass or some other render composites. In any event, the wires are preferably formed with helical ribs or grooves as defined in greater detail above and below.

Figure 2:
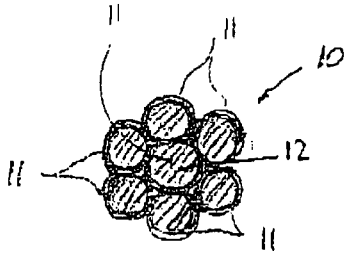
FIG. 2 is a section along the line 2—2 of FIG. 1.

The cable bolt 10 is constructed of seven wires 11 which combine in a strand to form the cable bolt. As is evident in FIG. 2, a central or king wire 12 is a straight wire around which the other six wires 11 are wound in a helical fashion. All the wires are formed from steel suitable for use in cable bolts, and as is evident from the drawings the wires 11 and the king wire 12 are helical ribbed wires of the same diameter. In other words, each wire has a helical rib 13 which extends along the wire on the outer surface thereof. Although the king wire 12 is preferably the same diameter, it may be 2–3% larger, in accordance with standard practices, or may be larger still if necessary, say up to 4 to 20% larger or more.

Figure 1:
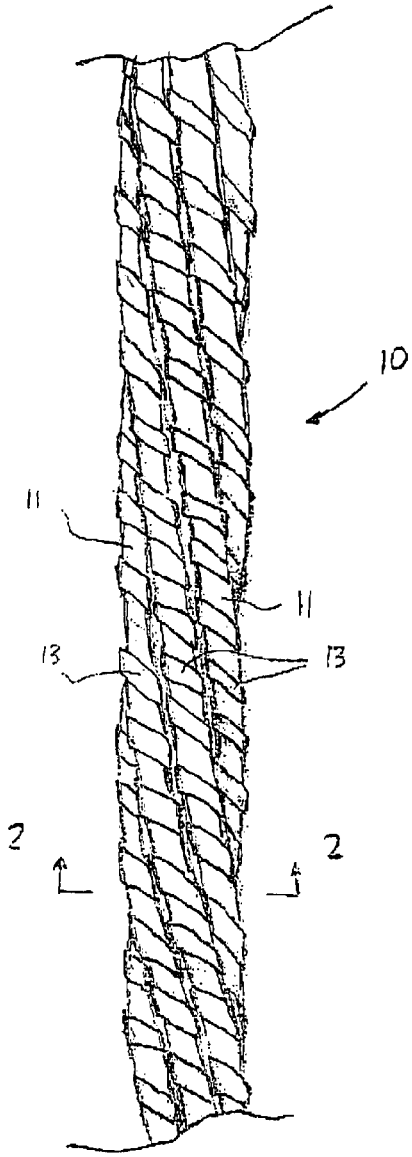
FIG. 1 is a side elevation of part of a length of cable bolt according to the invention.
Figure 3:
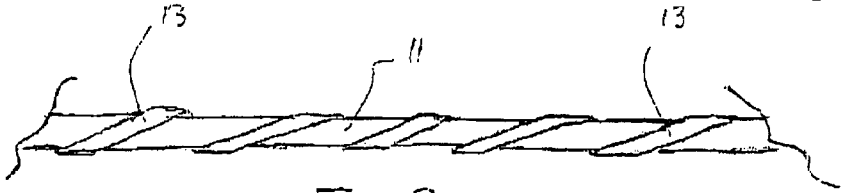
FIG. 3 shows portion of a length of wire of the kind used in the cable bolt of FIGS. 1 and 2.
Figure 4:
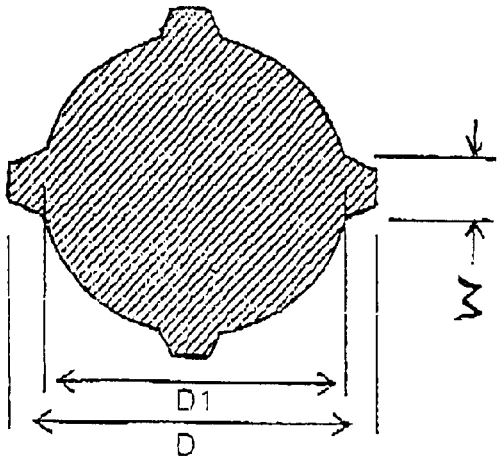
FIGS. 4 and 5 illustrate a typical outer wire having ribs or grooves.
Figure 5:
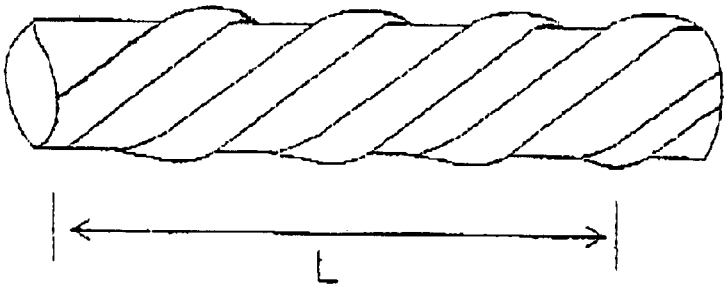

In accordance with this embodiment the wire is typically 5, 7 or 9 mm in diameter and the rib is of a width of about 20% of the nominal wire diameter and a height of about 8% of the nominal diameter. This is evident in FIG. 4 where D is at least 8% larger than D1 and W is at least 20% of D1. Typically the helically ribbed or grooved wire will have a diameter of the order of 7.5 mm and will have the form illustrated in FIGS. 3 and 4. The pitch of each of the helical ribs 13 is between 4 and 10 times the diameter D1, that is, L is 4 to 10 times D1 as is evident in FIG. 5. The benefits of using a helically ribbed wire as opposed to a conventional wire are as follows. As is evident in FIG. 1 there will be parts along the length of the cable bolt where the ribs of adjacent wires bear on each other and there will be other places where the rib of one wire fits between the ribs of an adjacent wire. This same situation occurs between the outer wires 11 and the king wire 12. As a consequence when the cable bolt is placed under strain, the outer wires are able to apply a force to the king wire at many points along the length of the cable bolt and therefore it is unnecessary for the king wire to be of a larger diameter. The result is that only one stock item of wire is required in order to manufacture the cable bolt. In addition, where the ribs of adjacent wires bear on each other creates a space or gap and therefore along the length of the cable bolt the wires are not as closely compacted as would be the case with a conventional cable bolt. The gaps between adjacent wire are not solely the result (in all configurations) of the ribs on the wire. In some cases, the gaps will be the result of the diameter of the king wire, as well as the ribs. The important thing about the invention is that the ribs will ensure there is always a minimum gap, rather than random gaps as is the case if non-ribbed wire is used. The consequence of this is that when the cable bolt is encapsulated in resinous or cementitious material (by spinning the cable bolt into the former or by pumping the latter into the borehole), the encapsulating material is able to penetrate much further between the wires of the cable bolt and therefore provide a much greater bonding. The encapsulating material may be polyester resin or cementitious grout. In other words, the encapsulation causes a greater interlocking between the cable bolt and the hole into which it is inserted.

The cable bolt of this invention may be used with a threaded end termination as described in applicant's earlier International Patent Application PCT/AU97/00587 or may use conventional wedge grips to terminate the outer end of the cable bolt when it is in use.

Figure 2A:
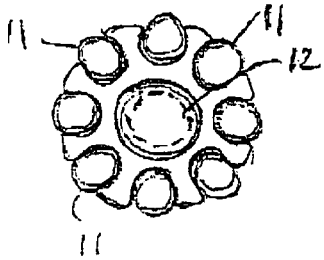
FIG. 2A is a section along 2—2 in FIG. 1 showing an alternative embodiment.

As illustrated in FIG. 2A the reinforcing member or cable bolt may incorporate a moulded plastics spacer, such as nylon, which holds the outer wires 11 apart in the manner illustrated. This embodiment particularly adapts itself to locate a tubular member instead of the core member 12, and the tubular member is illustrated in broken outline.

It should be evident to those skilled in the art that the cable bolt of this invention provides significant advantages over conventional cable bolts. For example, the cable bolt may consist of more or less than seven wires with an extra layer of wires around the outside of the cable bolt shown in this particular embodiment. Any number of wires of the same or different diameter can be arranged in one or more layers around the core or king wire or tube. Also, the dimensions and other features of the wires and the helical ribs may be varied. The king wire 12 may be replaced by a hollow tube in situations where top down grouting is required as opposed to grouting which is pumped into the hole from the bottom.

In claims defining the invention are as follows:

1. A cable bolt comprising:

a core wire or tube having a length; and a plurality of wires helically wound around the length of the core wire or tube, at least some of said wires being outer wires being ribbed wires having spaced helical surface ribs, wherein the ribs have dimensions such that the rib of one ribbed wire fits between the ribs of an adjacent ribbed wire at many points along the length of the core wire or tube, and the ribs of adjacent ribbed wires bear on each other at other points along the length to define a space between the wires.

2. A cable bolt as defined in claim 1, wherein said ribs extend along the ribbed wires for their entire length.

3. A cable bolt as defined in claim 2, wherein all said outer wires have said ribs.

4. A cable bolt as defined in claim 3, comprising six outer wires helically wound around said core wire or tube, all of said outer wires being formed with said helical ribs.

5. A cable bolt as defined in claim 4, wherein the outer wires have four separate spaced said helical ribs extending therealong.

6. A cable bolt as defined in claim 5, wherein said ribs each have a width equal to about 20% of nominal wire diameter and a height of about 8% of nominal wire diameter.

7. A cable bolt as defined in claim 6, wherein each helical rib has a pitch which is between four and ten times the nominal wire diameter.

8. A cable bolt as defined in claim 7, wherein said core wire is identical to said outer wires.

9. A cable bolt as defined in claim 7, comprising six outer wires helically wound around a central straight tube.

* * * * *